US009334588B2

(12) United States Patent
Kosui et al.

(10) Patent No.: US 9,334,588 B2
(45) Date of Patent: May 10, 2016

(54) THREE-DIMENSION FABRIC

(75) Inventors: Tatsuya Kosui, Wakayama (JP); Hiroaki Date, Otsu (JP); Ryosuke Yamao, Osaka (JP); Hiroshi Tsuchikura, Otsu (JP)

(73) Assignee: Toray Industries, Inc. (JP)

( * ) Notice: Subject to any disclaimer, the term of this patent is extended or adjusted under 35 U.S.C. 154(b) by 171 days.

(21) Appl. No.: 13/996,888

(22) PCT Filed: Dec. 21, 2011

(86) PCT No.: PCT/JP2011/079624
§ 371 (c)(1),
(2), (4) Date: Jun. 21, 2013

(87) PCT Pub. No.: WO2012/086681
PCT Pub. Date: Jun. 28, 2012

(65) Prior Publication Data

US 2013/0273331 A1 Oct. 17, 2013

(30) Foreign Application Priority Data

Dec. 22, 2010 (JP) ..... 2010-285751

(51) Int. Cl.

| | |
|---|---|
| ***D04B 1/10*** | (2006.01) |
| ***D04B 21/06*** | (2006.01) |
| ***A47C 31/00*** | (2006.01) |
| ***D03D 1/00*** | (2006.01) |
| ***D03D 3/08*** | (2006.01) |
| ***D03D 15/04*** | (2006.01) |
| ***D03D 15/08*** | (2006.01) |

(52) U.S. Cl.
CPC ..... *D04B 1/10* (2013.01); *A47C 31/006* (2013.01); *D03D 1/0017* (2013.01); *D03D 3/08* (2013.01); *D03D 15/04* (2013.01); *D03D 15/08* (2013.01); *D04B 1/102* (2013.01); *D04B 21/06* (2013.01); *Y10T 428/24636* (2015.01)

(58) Field of Classification Search
None
See application file for complete search history.

(56) References Cited

U.S. PATENT DOCUMENTS

| | | | | | |
|---|---|---|---|---|---|
| 4,876,774 | A | * | 10/1989 | Kavesh et al. | 428/902 |
| 5,582,463 | A | * | 12/1996 | Linder et al. | 297/452.2 |
| 6,102,482 | A | * | 8/2000 | Dettoni et al. | 297/452.56 |
| 6,254,190 | B1 | * | 7/2001 | Gregory | 297/452.1 |
| 6,378,949 | B1 | * | 4/2002 | Maeda et al. | 297/452.56 |

(Continued)

FOREIGN PATENT DOCUMENTS

| | | | |
|---|---|---|---|
| DE | 20 2006 016 338 | | 2/2007 |
| EP | 1 915 926 | | 4/2008 |
| JP | 2000-027057 | A | 1/2000 |
| JP | 2002-219985 | A | 8/2002 |
| JP | 2003-510115 | A | 3/2003 |
| JP | 2003-159141 | A | 6/2003 |
| JP | 2004-033543 | A | 2/2004 |

(Continued)

OTHER PUBLICATIONS

Supplementary European Search Report dated May 8, 2014 from corresponding European Patent Application No. 11 85 0702.

*Primary Examiner* — David Sample
*Assistant Examiner* — Donald M Flores, Jr.
(74) *Attorney, Agent, or Firm* — DLA Piper LLP (US)

(57) ABSTRACT

A three-dimension fabric by which a three-dimension fabric surface can be formed by supporting the fabric edges by a frame member and stretching the fabric, wherein the fabric per se, which constitutes the fabric surface, is provided with at least one heterogeneous portion that is different at least in yarn type and/or fabric structure type from the adjacent portion. Thus, the three-dimension fabric can be easily made into a construct of a desirable shape without using a frame having a complicated shape.

16 Claims, 8 Drawing Sheets

(56) References Cited

U.S. PATENT DOCUMENTS

| | | | | |
|---|---|---|---|---|
| 6,435,618 | B1 * | 8/2002 | Kawasaki | 297/452.56 |
| 6,485,103 | B1 * | 11/2002 | Yamada et al. | 297/452.56 |
| 6,632,756 | B1 * | 10/2003 | Waldrop et al. | 442/314 |
| 2003/0096547 | A1 * | 5/2003 | Oka et al. | 442/184 |
| 2003/0101776 | A1 * | 6/2003 | Shirasaki et al. | 66/196 |
| 2004/0137822 | A1 * | 7/2004 | Mitchell | 450/75 |

FOREIGN PATENT DOCUMENTS

| | | | |
|---|---|---|---|
| JP | 2004-211275 | A | 7/2004 |
| JP | 2005-330645 | A | 12/2005 |
| JP | 2006-132047 | A | 5/2006 |
| JP | 2007-117537 | A | 5/2007 |
| JP | 2009-052157 | A | 3/2009 |
| JP | 2009-233403 | A | 10/2009 |

* cited by examiner $a < R\pi$ $b < L$ $$a = R\pi$$
$$b = L$$

THREE-DIMENSION FABRIC

TECHNICAL FIELD

This disclosure relates to a three-dimension fabric suitable to be used for an object supporting surface such as a backrest and seating surface, having a three-dimension shape of an object supporting tool such as a chair.

BACKGROUND

There has been a body supporting tool such as an office chair and car seat, which supports a body with a cushioned body supporting surface such as a backrest and seating surface. Other than the body supporting tool, even an object supporting tool is sometimes required to have a cushioned object supporting surface to support a three-dimension object like a body. Such a cushioned object supporting surface often comprises a core member such as a metal frame, a foamed elastic member such as urethane foam, and an elastic body which covers them.

Recently, a well cushioned chair provided with a body supporting surface made of knitted or woven fabric mesh sheet instead of inner urethane foam is commercially available, and new product designs are appearing (See JP2007-117537-A and JP2006-132047-A). JP2007-117537-A discloses a chair having a backrest made of a sheet member having a saclike periphery through which a bone of a core member is inserted for a support JP2006-132047-A discloses a chair provided with a seating surface of a warp-knitted fabric manufactured by a double raschel warp knitting machine. The warp-knitted fabric is cushioned with the inserted weft made of elastic yarns. In both publications, only one kind of each fabric structure and each yarn is disclosed.

If a mesh sheet is used and the metal frame is made planar rectangle, the object supporting surface becomes planar, too. However, the object such as a body to be supported with the object supporting surface has a three-dimensional shape. The planar object supporting surface, even if well cushioned, tends to elastically deform greatly to support a prominent portion of an object such as a body so that a great reaction force is continuously generated to be applied to the body at the supporting portion. It is important for chairs to be comfortable that the elasticity, which means the initial tension, is adjusted properly at each portion by making the supporting surface fit to the shape of the contact surface of the object to be supported.

In the techniques disclosed in the above-described patent documents, hard work to assemble intricately-shaped frames and mesh fabrics under a high tension condition is required to optimize shape and elasticity of the supporting surface.

Accordingly, it could be helpful to provide a three-dimension fabric which can be used to make a desirable structure easily and of which object supporting surface can be easily shaped and elasticized at each portion, even if intricately-shaped frames are not used.

Besides, it is not a good solution that different materials and different fabrics are assembled by sewing or bonding at each portion on a supporting body. Namely, such a solution is not practical because of the high cost as well as the difficulty in sewing or bonding the mesh sheets.

SUMMARY

We thus provide a three-dimension fabric for forming a three-dimension fabric surface by being stretched while an edge part of the fabric is supported with a frame member, characterized in that the fabric that forms the fabric surface includes at least one heterogeneous portion of which yarn and/or fabric structure is different from an adjacent portion.

In the three-dimension fabric, it is possible that the heterogeneous portion and the adjacent portion are formed in three-dimensional shapes different from each other. For example, the heterogeneous portion and the adjacent portion are formed in three-dimensional shapes different from each other by a difference of a shrink and/or tension between the heterogeneous portion and the adjacent portion. Specifically, the heterogeneous portion and the adjacent portion are formed in three-dimensional shapes having curved surface different from each other.

When the three-dimension fabric surface is formed by stretching, it is possible that the edge part of the fabric having a shape along the frame member is supported with the frame member, or that the edge part of the fabric having a notch part corresponding to a shape of the frame member is supported with the frame member. The notch part may have a curved shape as shown in an example described later. In both configurations of the three-dimension fabric, it is possible that the heterogeneous portion and the adjacent portion are formed in three-dimensional shapes different to each other by a difference of a shrink and/or tension.

To form the fabric surface into a desirable three-dimensional shape, it is possible that the fabric stretched with frame member is heated to shrink and form a three-dimensional shape different from the one before heated. We provide a preferable method such as a heat shrinkage method. Namely, it is preferable that the fabric includes portions different from each other by at least 5% in a dry-heat shrinkage, which is defined by determining at least two unheated square cut pieces of fabric portions with a side as long as at least 5 times of a diameter of a main fiber having at least 50% proportion by weight among fibers included in the fabric to form each portion, at 160° C. in warp and weft directions.

It is possible that the fabric includes at least one heterogeneous portion of which yarn and/or fabric structure is different from an adjacent portion and that the heterogeneous portion and the adjacent portion are formed in three-dimensional shapes different from each other, as described above. Alternatively, either with or without forming the three-dimensional shapes different from each other, it is possible that the heterogeneous portion and the adjacent portion are formed to have a different characteristic from each other. Namely, it is possible that the fabric includes said at least one heterogeneous portion of which yarn and/or fabric structure is different from the adjacent portion, to form portions having at least one characteristic different from each other among elasticity, air permeability and texture.

Thus, in our three-dimension fabric, the fabric surface as forming the object supporting surface can be configured to change the yarn or fabric structure according to each portion and to utilize the difference of the shrinkage generated by applying the heat set at a temperature corresponding to materials while the fabric is set in the frame member. Thus, even if an intricately-shaped frame is not used, a three-dimensional shape such as a curved surface to fit a contact surface of an object to be supported and desirable characteristics such as elasticity can be easily achieved by simple methods.

It is possible that one portion is configured to have a shrinkage and tension in the warp direction much greater than that in the weft direction to form a flat surface connecting two portions adjacent in the warp direction. In reverse, it is possible that one portion is configured to have a shrinkage and tension in the weft direction much greater than that in the warp direction to form a flat surface connecting two portions adjacent in the weft direction. Though a misalignment in the normal direction may be generated by the positional relation of the two portions adjacent along the warp direction and the two portions adjacent along the weft direction, a curved surface connecting the four adjacent portions can be formed if the shrinkage and tension in the warp and weft directions are well balanced in the center. As a result, a desirable curved surface can be formed at a target portion differently from the periphery in the whole fabric surface and, therefore, a three-dimension fabric surface having desirable curved surface portions can be formed easily without sewing and bonding the fabric per se, as preventing the above-described difficult assembly.

Fibers included in the fabric are not specifically limited. If the three-dimension fabric surface is required to have a certain elasticity, etc., it is preferable that a main fiber having at least 50% proportion by weight among fibers included in the fabric to form each portion is made of an elastomer polyester. Natural fiber as well as synthetic fibers can be used and in particular, a polyester fiber or a polyamide fiber is suitably used.

The fabric can be either a woven fabric or a knitted fabric as a fabric structure to form a desirable three-dimension fabric surface. The above-described differences of shrinkage and tension in the warp and weft directions at each portion can be achieved by changing the yarn and fabric structure which are included in the fabric. Concretely, the differences can be achieved by designing to make each portion such as weft-knitted by shaping or jacquard.

The knitted fabric may even be a warp-knitted fabric though the weft-knitted fabric is preferable for the knitting. The weft-knitted structure may be a plain stitch (with the face stitch knitting), garter structure with the alternate face and purl stitch knitting along the warp direction), smooth structure (with the alternate knit and welt) or a rib structure (with the alternate face and purl stitch knitting along the weft direction).

The knitted structure can be combined with the welt and tuck knitting to decrease the number of stitches in the longitudinal direction, so as to increase the longitudinal tension. A lesser number of stitches comparison to the periphery makes the tension increase. Even if the number of stitches does not change, the garter structure can increase the longitudinal tension and the rib structure can increase the lateral tension.

In knitting each portion, the elasticity characteristics differ depending on flat knitting machines and its gauges, as well as materials and thicknesses of the yarn. The knitting method can be selected or designed based on desired characteristics at each portion.

The three-dimension fabric is applicable to everything required to form a desirable three-dimension fabric surface without sewing and bonding, and is suitable to a backrest and seating surface of chairs.

The three-dimension fabric makes it possible that the supporting surface is improved to have a target desirable three-dimensional shape by a simple assembly even without a frame of complicated shape. Therefore, an object supporting surface having desirable curved surfaces can easily be achieved. Further, the functional design becomes greatly flexible so that the object to be supported can be made to locally sink or supported by the surface without sinking. Furthermore, the elasticity, air permeability and texture at each portion can be changed to be given the optimum function at each portion. Also, because the color and drape can be changed, the design can be given an added value easily.

EXPLANATION OF SYMBOLS

1: frame member
2, 3, 4, 6, 8: three-dimension fabric
5, 7: fabric before being set in frame
9*a*, 9*b*, 9*c*: notch
i-iv: portion

DETAILED DESCRIPTION

Hereinafter, examples of our fabrics will be explained as referring to the figures.

Figure 1:
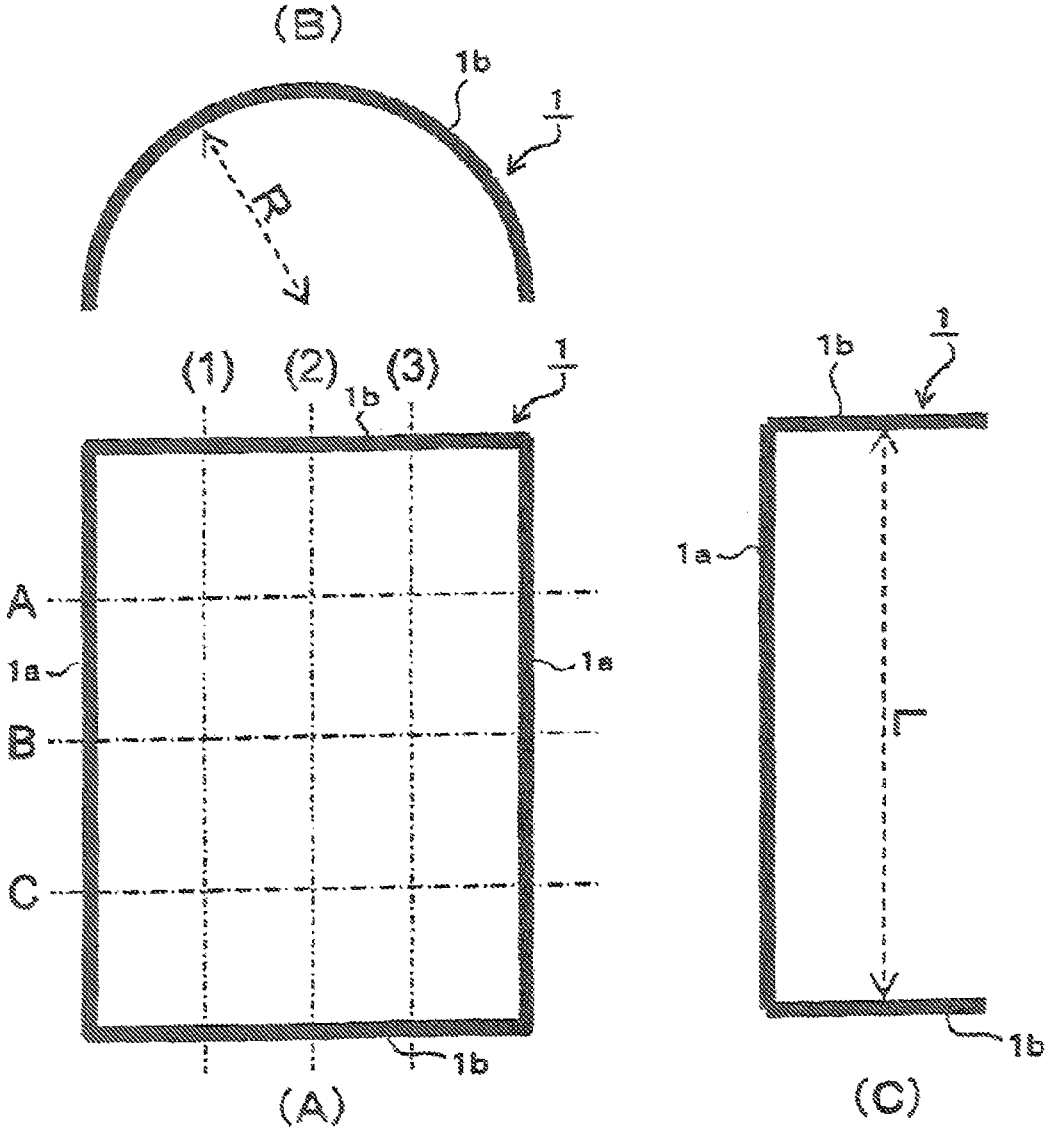
FIG. 1 shows a frame member of a three-dimension fabric according to an example, where (A) is an elevation view, (B) is a to view, and (C) is a side view.

FIG. 1 shows an example of a frame member, which is the one used in the Examples and Comparative Examples to be described, of a three-dimension fabric according to an example of our fabric. In this example, frame member 1 is made of metal and sufficiently rigid, and can alternatively be made of plastic. Frame member 1 has a rectangular shape as shown in FIG. 1 (A) as the elevation view, and its both sides comprise linear bodies 1*a* which extend linearly. The top and bottom sides comprise linear bodies 1*b* which bend with curvature radius R as shown in FIG. 1 (B) as the top view, and the distance between the top and bottom sides has been set to L as shown in FIG. 1 (C) as the side view. Besides, symbols of A, B. C and (1), (2), (3) respectively illustrate vertical and horizontal positions of frame member 1, to help explaining shapes of three-dimension fabrics in the Examples and Comparative Examples to be described.

EXAMPLES

Example 1

Figure 2:
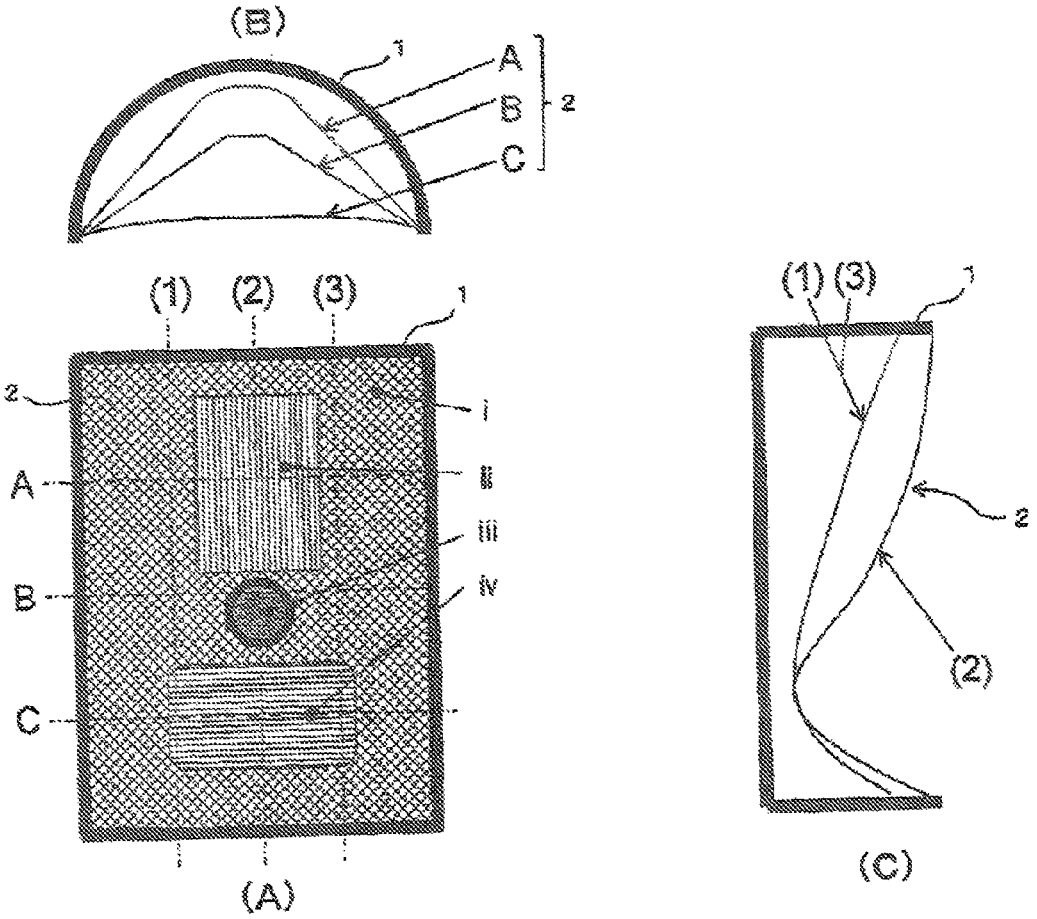
FIG. 2 shows a three-dimension fabric according to Example 1, where (A) is an elevation view, (B) is a top view, and (C) is a side view.

FIG. 2 shows elevation view (A), top view (B) and side view (C) of three-dimension fabric 2 according to Example 1, where the fabric is stretched while the edge parts are supported by frame member 1 and heated to shrink at each portions to form a three-dimension fabric surface having desirable curved surface portions without sewing and bonding. In this Example, four kinds of fabric structures are included in one fabric surface such as an object supporting surface.

The three-dimension fabric in this Example is a knitted fabric made by a flat knitting machine having front and rear needle beds, such as "NSSG (registered trademark)" of Shima Seiki Mfg., Ltd. The three-dimension fabric may be made of thermal adhesive elastic yarn such as "Hytrel (Registered trademark)".

Portion i constituting the object supporting surface is knitted by a face stitch, and heated after stretching to achieve elasticity characteristics being uniform in longitudinal and lateral directions.

Portion ii is knitted by a smooth structure with alternate knit and welt. Such a smooth structure can reduce the number of stitches in a longitudinal direction to half relative to peripherally-surrounding portion i, so that even the number of stitches per unit area is reduced to half relative to portion i in a condition where the fabric is stretched while supported by the frame member and then the longitudinal tension is increased. Alternatively, the smooth structure can be replaced by a garter structure which shrinks in a longitudinal direction.

At portion iii, the peripheral shape is round and anelastic structure is formed inside. In this Example, such an anelastic structure is a combination of knit and tuck, and can be a combination of knit and welt alternatively. In these structures, the tuck and welt can suppress the stretching. Inside portion iii, a structure which is very elastic in longitudinal and lateral directions has been formed by combining the garter structure and rib structure.

Portion iv is formed to shrink greatly in a lateral direction by the rib structure. The rib structure is made with a face stitch knitting and a purl stitch knitting, which are repeatedly organized along the lateral direction with respect to each predetermined number. In this Example, they are organized with 2×2 rib structure. Characteristics of such a rib structure increase the tension in the lateral direction in spite of the same number of stitches as the peripherally-surrounding portion i. To make the tension desirable, 1×1 rib structure or 3×3 rib structure may be selected.

Thus, the combination of portions ii, iii and iv having fabric structures different from portion i achieves a supporting surface (fabric surface) having a complex curved surface with different shapes at each portion as shown in FIGS. 2 (B) and (C). At portion iii, there is a local subduction different from the peripheral portion.

Comparative Example 1

Figure 3:
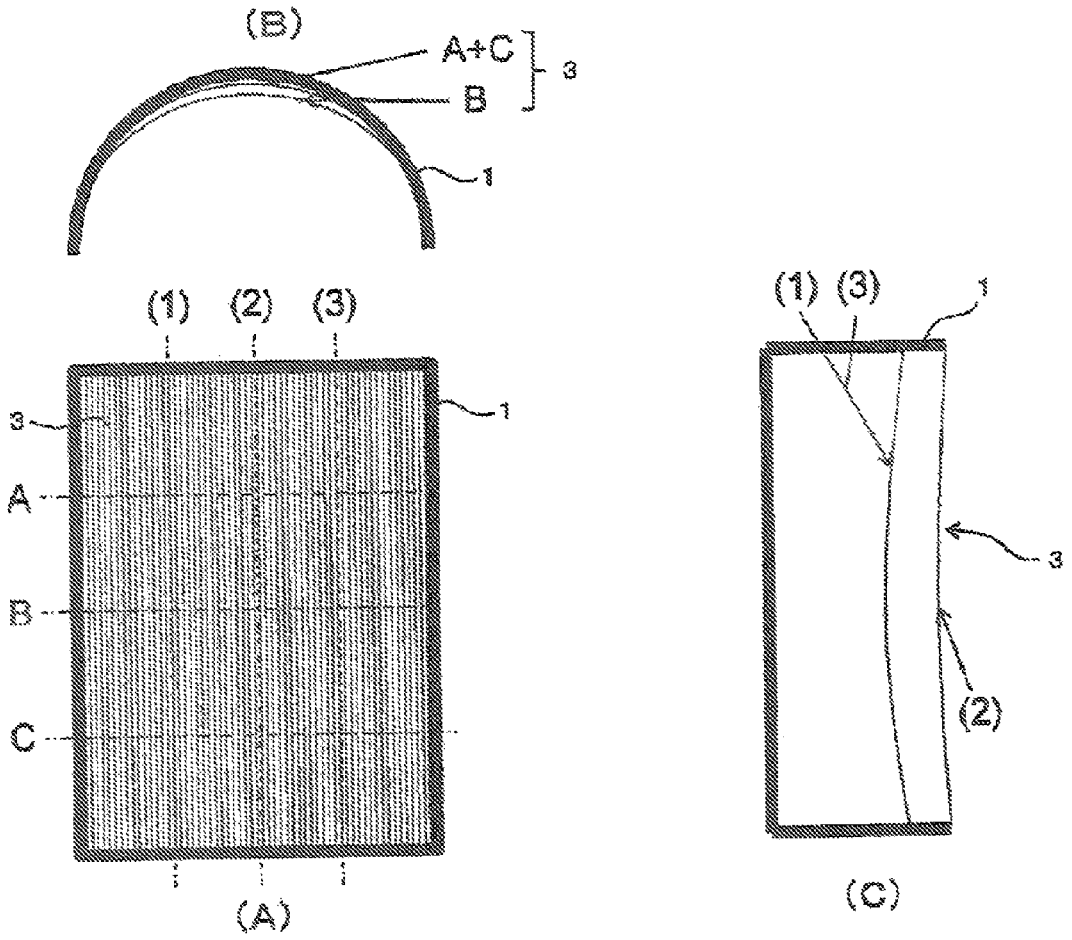
FIG. 3 shows a three-dimension fabric according to Comparative Example 1, where (A) is an elevation view, (B) is a top view, and (C) is a side view.

FIG. 3 shows elevation view (A), top view (B) and side view (C) of three-dimension fabric 3 in Comparative Example 1 which is shown for comparison to Example 1, where the fabric surface constituting an object supporting surface is made mainly of a fabric which is organized with the warp uniformly positioned to shrink the fabric surface greatly in the warp direction. It remains semicylindrical along frame member 1. Even coefficients of elasticity are not greatly different depending on portions. Therefore, it is difficult to form a complex curved surface with different shapes at each portion as well as a fabric surface with different characteristics at each portion.

Comparative Example 2

Figure 4:
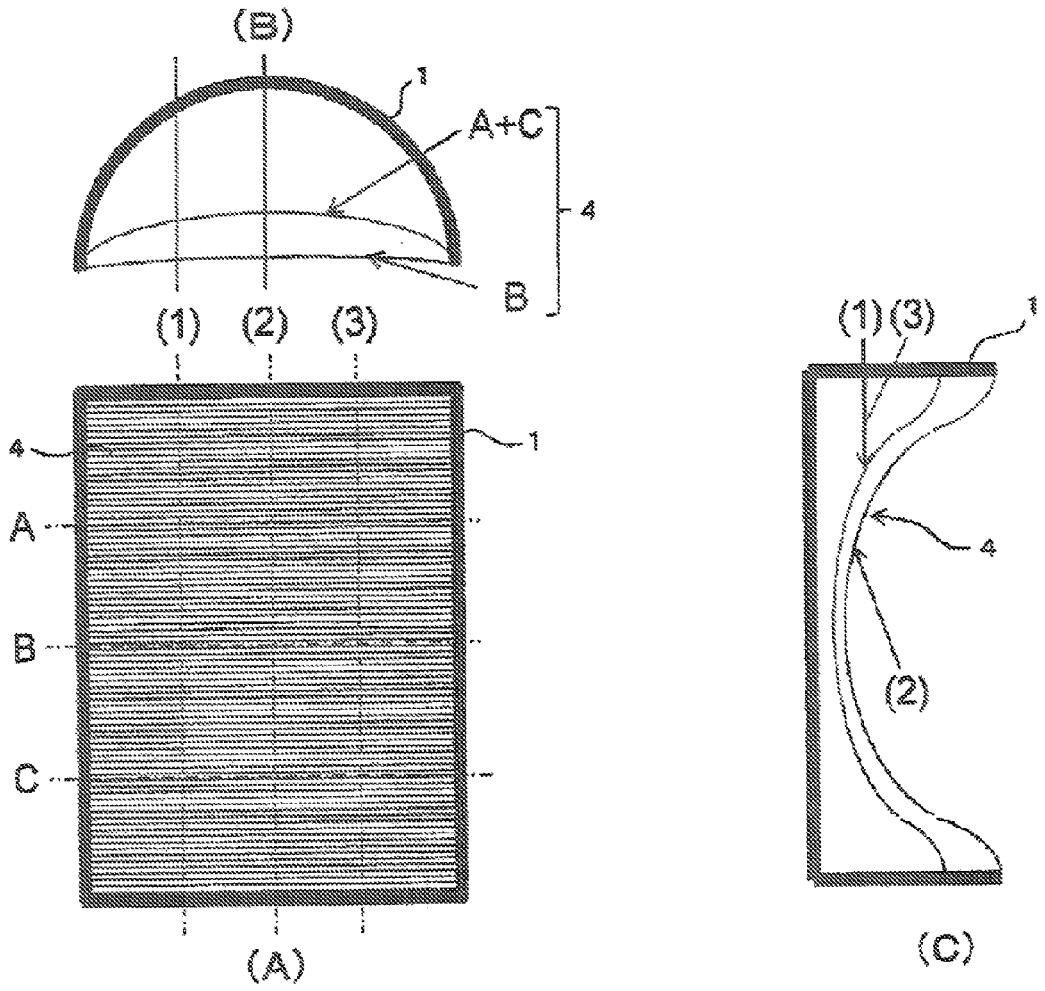
FIG. 4 shows a three-dimension fabric according to Comparative Example 2, where (A) is an elevation view, (B) is a top view, and (C) is a side view.

FIG. 4 shows elevation view (A), top view (B) and side view (C) of three-dimension fabric 4 in Comparative Example 2 which is shown for comparison to Example 1, where the fabric surface constituting an object supporting surface is made mainly of a fabric which is organized with the weft uniformly positioned to shrink the fabric surface greatly in the welt direction. The fabric surface is made symmetric in the warp and weft directions though more or less curved than the semicylindrical shape along frame member 1. Therefore, it is difficult to form a complex curved surface with different shapes at each portion as well as a fabric surface with different characteristics at each portion.

Example 2

Figure 5:
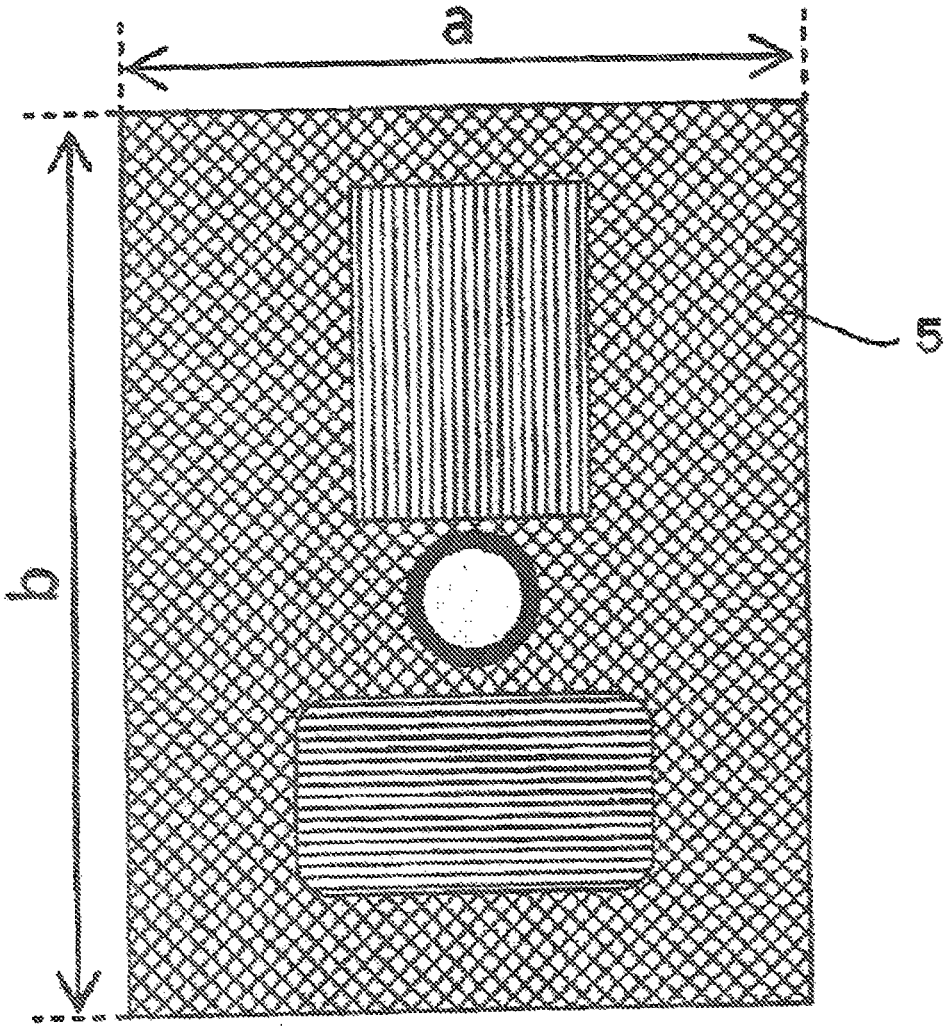
FIG. 5 is an elevation view of a three-dimension fabric before being set in a frame according to Example 2.
Figure 6:
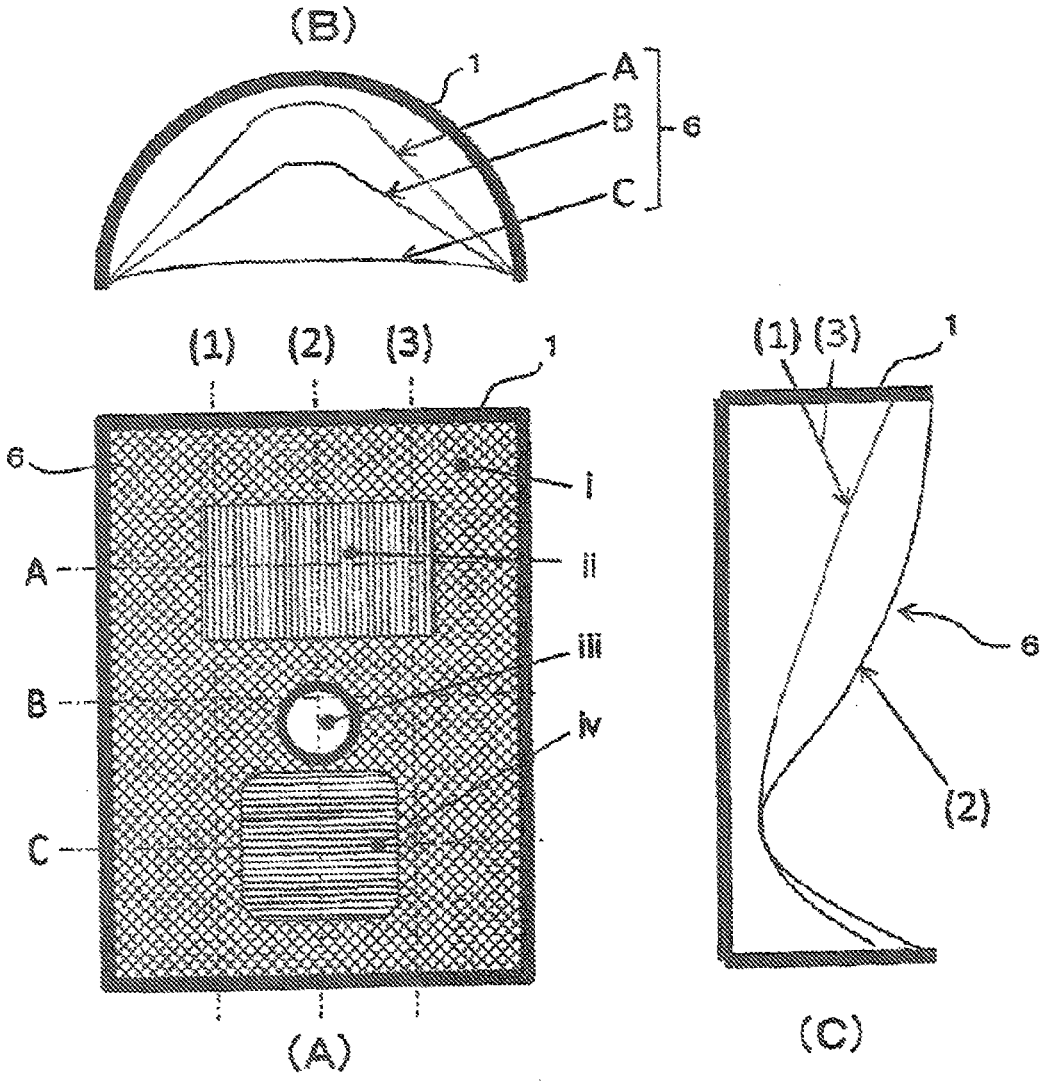
FIG. 6 shows the three-dimension fabric according to Example 2 of the present invention, where (A) is an elevation view, (B) is a top view, and (C) is a side view.

FIG. 5 and FIG. 6 show a three-dimension fabric according to Example 2. Fabric 5 before being set in the frame is shown in FIG. 5 as an elevation view. Three-dimension fabric 6 stretched by frame member 1 to have a complex curved surface is shown in FIG. 6 with elevation view (A), top view (B) and side view (C). Fabric 5 before being set in the frame is configured to make width a and longitudinal direction length b satisfy relations of $a<R\pi$ and $b<L$. Fabric 5 is stretched while the edge parts are supported by frame member 1, which is larger than the fabric before being set in the frame, by utilizing the stretch characteristics to form a surface of the three-dimension fabric having a mixture of desirable curved surface portions without sewing and bonding.

In this Example, the same kind of warp and weft yarns which is uniformly woven or knitted is stretched and then extended to generate a uniform stretch tension in the warp and weft directions at portion i (with uniform stretch in the warp and weft directions) of three-dimension fabric 6. At portion ii (with smaller warp stretch and greater weft stretch), the stretch in the warp direction is much smaller than the one in the weft direction so that the tension is applied greatly in the warp direction. At portion iv (with greater warp stretch and smaller waft stretch), the stretch in the weft direction is much smaller than the one in the warp direction so that the tension is applied greatly in the weft direction. At portion iii (with peripheral stretch=0, inner stretch=local maximum), the periphery in which anelastic fibers are knitted by a high density is round and the inner fabric portion is made highly elastic. Thus, the combination of portions ii, iii and iv which are made of yarns different from portion i achieves a supporting surface (fabric surface) having a complex curved surface with different shapes at each portion as shown in FIGS. 6 (B) and (C), like Example 1. At portion iii, there is a local subduction different from the peripheral portion. Specifically in this Example, the difference of yarn types makes the fabric structures different at each portion to make the warp and weft stretch stresses different from portion i.

Example 3

Figure 7:
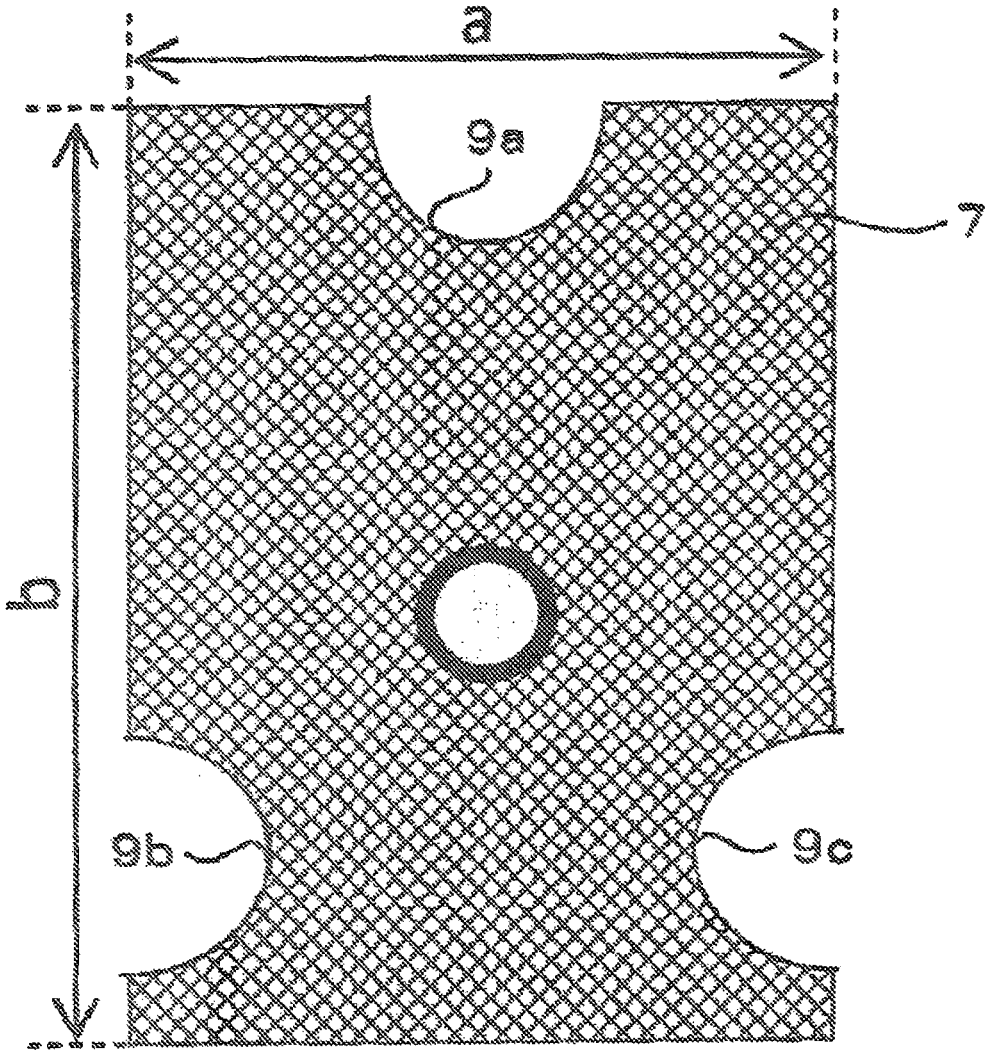
FIG. 7 is an elevation view of a three-dimension fabric before being set in a frame according to Example 3.
Figure 8:
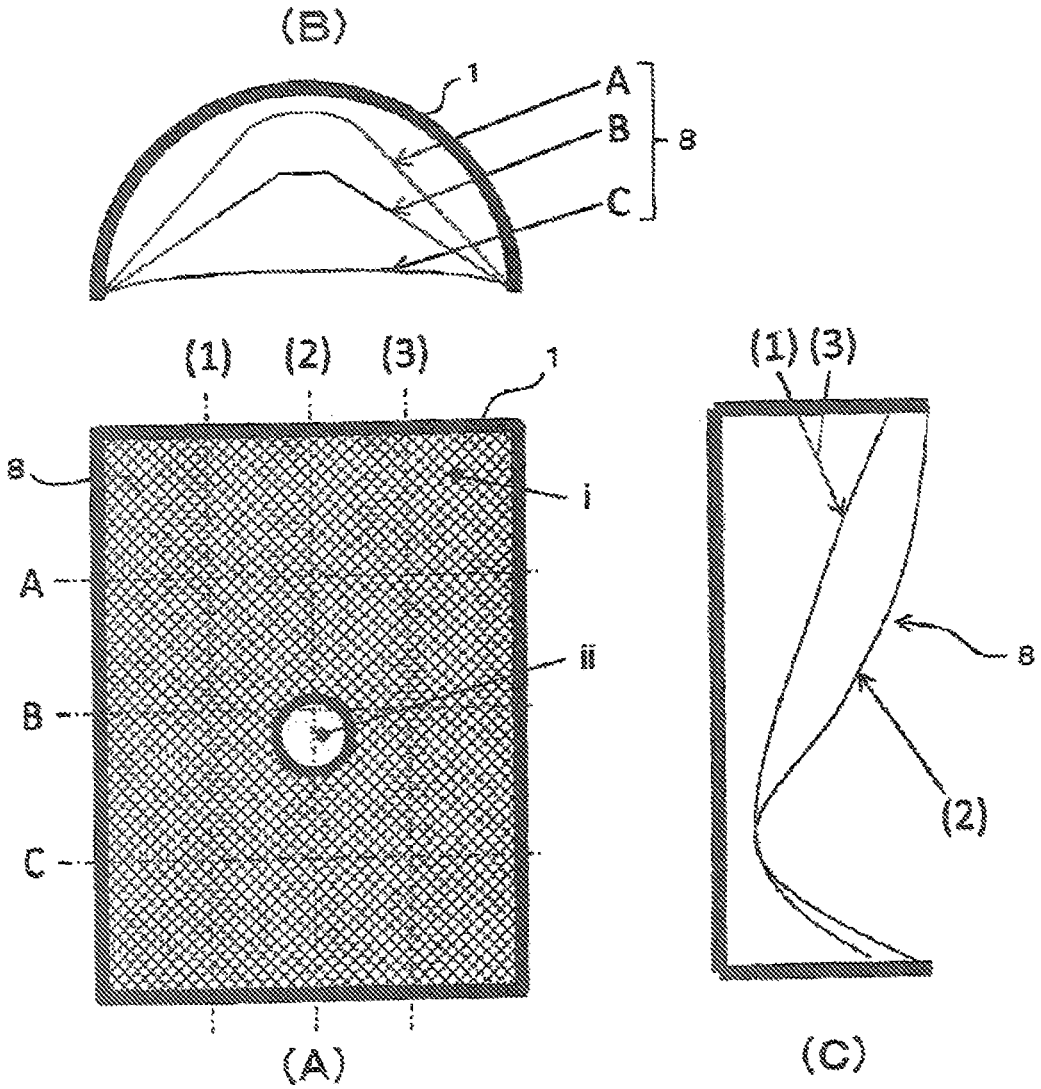
FIG. 8 shows the three-dimension fabric according to Example 3 of the present invention, where (A) is an elevation view, (B) is a top view, and (C) is a side view.

FIG. 7 and FIG. 8 show a three-dimension fabric according to Example 3. Fabric 7 before being set in the frame is shown in FIG. 7 as an elevation view. Three-dimension fabric 8 stretched by frame member 1 to have a complex curved surface is shown in FIG. 8 with elevation view (A), top view (B) and side view (C). Fabric 7 before being set in the frame is configured to make width a and longitudinal direction length b satisfy relations of $a=R\pi$ and $b=L$. In this Example, fabric 7 before being set in the frame is provided with semicircular notches 9*a*, 9*b* and 9*c* to a shape along frame member 1. Fabric 7 is stretched while the edge parts are supported by frame member 1 as the notch parts generate the local stretch stress along a flat frame to form a surface of the three-dimension fabric having a mixture of desirable curved surface portions without sewing and bonding.

In this Example, the same kind of warp and weft yarns is uniformly woven or knitted, stretched and then heated to shrink uniformly in the warp and weft directions so that the tension is applied uniformly at portion i (with uniform stretch in the warp and weft directions). At portion ii (with peripheral stretch=0, inner stretch=local maximum), the periphery in which anelastic fibers are knitted by a high density is round and the inner fabric portion is made highly elastic. Thus, portion ii made of different yarns and fabric structures is combined with portion i while fabric 7 before being set in the frame is provided with notches 9*a*, 9*b* and 9*c* to achieve a supporting surface (fabric surface) having a complex curved surface with different shapes at each portion as shown in FIGS. 8 (B) and (C), like Examples 1 and 2. In position C, notches 9*b* and 9*c* contributed a local subduction different from the peripheral portion.

INDUSTRIAL APPLICATIONS

The three-dimension fabric is applicable to everything required to easily form a desirable three-dimension fabric surface, and is suitable for a supporting surface of a body supporting tool such as office chairs and car seats.

The invention claimed is:

1. A three-dimension fabric having a three-dimension fabric surface formed by stretching while an edge part of the fabric is supported with a frame member, wherein the fabric comprises at least one heterogeneous portion of which yarn and/or fabric structure is different from a peripherally-surrounding adjacent portion, and the heterogeneous portion and the peripherally-surrounding adjacent portion are formed in three-dimensional shapes having curved surface different from each other.

2. The three-dimension fabric according to claim 1, wherein the three-dimension fabric surface is formed without sewing or bonding into a three-dimensionally curved surface portion.

3. The three-dimension fabric according to claim 2, wherein the edge part of the fabric has a shape along the frame member.

4. The three-dimension fabric according to claim 2, wherein the edge part of the fabric has a notch part corresponding to a shape of the frame member.

5. The three-dimension fabric according to claim 1, wherein the heterogeneous portion and the adjacent portion are formed in three-dimensional shapes different from each other by a difference of a shrink and/or tension between the heterogeneous portion and the adjacent portion.

6. The three-dimension fabric according to claim 5, wherein the edge part of the fabric has a shape along the frame member.

7. The three-dimension fabric according to claim 5, wherein the edge part of the fabric has a notch part corresponding to a shape of the frame member.

8. The three-dimension fabric according to claim 1, wherein the edge part of the fabric has a shape along the frame member.

9. The three-dimension fabric according to claim 8, wherein the edge part of the fabric has a notch part corresponding to a shape of the frame member.

10. The three-dimension fabric according to claim 1, wherein the edge part of the fabric has a notch part corresponding to a shape of the frame member.

11. The three-dimension fabric according to claim 1, wherein the fabric stretched with the frame member has been heated to shrink to form a three-dimensional shape different from the one before heated.

12. The three-dimension fabric according to claim 11, wherein the fabric includes portions different from each other by at least 5% in a dry-heat shrinkage, which is defined by determining at least two unheated square cut pieces of fabric portions with a side as long as at least 5 times of a diameter of a main fiber having at least 50% proportion by weight among fibers included in the fabric to form each portion, at 160° C. in warp and weft directions.

13. The three-dimension fabric according to claim 1, wherein the heterogeneous portion and the adjacent portion are formed to have a different characteristic of any one of elasticity, an air permeability or a texture from each other.

14. The three-dimension fabric according to claim 1, wherein a main fiber having at least 50% proportion by weight among fibers included in the fabric to form each portion is made of an elastomer polyester.

15. The three-dimension fabric according to claim 1, wherein the fabric is a woven fabric.

16. The three-dimension fabric according to claim 1, wherein the fabric is a knitted fabric.

* * * * *